US005213587A

United States Patent [19]

Ekström et al.

[11] Patent Number: 5,213,587

[45] Date of Patent: May 25, 1993

[54] REFINING OF RAW GAS

[75] Inventors: Clas Ekström, Stockholm; Bengt-Göran Espenäs, Nyköping; Waclaw Kowalic, Skärholmen; Erik Rensfelt, Nyköping; Lars Waldheim, Skärholmen, all of Sweden

[73] Assignee: Studsvik AB, Nyköping, Sweden

[21] Appl. No.: 879,461

[22] Filed: May 4, 1992

Related U.S. Application Data

[63] Continuation of Ser. No. 733,969, Jul. 22, 1991, abandoned, which is a continuation of Ser. No. 469,414, Apr. 2, 1990, abandoned.

[30] Foreign Application Priority Data

Oct. 2, 1987 [SE] Sweden ..... 8703816

[51] Int. Cl.[5] ..... C10K 1/34; C10J 3/14

[52] U.S. Cl. ..... 48/197 R; 48/203; 48/209; 413/230; 413/237

[58] Field of Search ..... 48/197 R, 203, 209, 48/210; 423/230, 237, 240 S, 244 A, 244.08, 244.07, 244.09, 244.01, DIG. 16

[56] References Cited

U.S. PATENT DOCUMENTS

| | | | |
|---|---|---|---|
| 3,807,090 | 4/1974 | Moss . | |
| 3,907,971 | 9/1975 | Bohm et al. | 423/240 S |
| 4,076,796 | 2/1978 | Reh et al. | 423/DIG. 16 |
| 4,123,502 | 10/1978 | Holter et al. | 423/230 |
| 4,206,186 | 6/1980 | Holter et al. | 423/230 |
| 4,233,275 | 11/1980 | Kimura et al. | 423/237 |
| 4,243,635 | 1/1981 | Aeberli | 423/240 S |
| 4,273,749 | 6/1981 | Kimura et al. . | |
| 4,374,105 | 2/1983 | Anderson et al. | 423/230 |
| 4,539,188 | 9/1985 | Hirsch et al. | 423/230 |
| 4,548,797 | 10/1985 | Sauer et al. | 423/240 S |
| 4,552,732 | 11/1985 | Hillekamp | 423/240 S |
| 4,613,344 | 9/1986 | Henrich et al. | 423/230 |
| 4,668,489 | 5/1987 | Alexander et al. | 423/240 S |
| 4,718,362 | 1/1988 | Santen et al. | 110/346 |
| 4,744,964 | 5/1988 | Kuhl | 423/230 |
| 4,844,875 | 7/1989 | Ettehadieh | 423/240 S |
| 4,884,396 | 12/1989 | Miyamoto et al. | 423/230 |

FOREIGN PATENT DOCUMENTS

| | | | |
|---|---|---|---|
| 0220342 | 5/1987 | European Pat. Off. . | |
| 3023480 | 1/1982 | Fed. Rep. of Germany . | |
| 3322159 | 1/1985 | Fed. Rep. of Germany . | |
| WO86/01822 | 3/1986 | PCT Int'l Appl. . | |
| 1183937 | 3/1970 | United Kingdom | 423/244 A |
| 2180849 | 4/1987 | United Kingdom . | |

OTHER PUBLICATIONS

Yerushalmi et al, "High Velocity Fluid Beds", Chemtech, Sep. 1978, pp. 564–572.

Reh, "Fluidized Bed Processing", Chemical Engineering Progress, vol. 67, 202, Feb. 1971, pp. 58–63.

"Chemistry of Catalytic Processes" by Bruce C. Cates, et al. (McGraw-Hill Book Company, pp. 1 to 5).

(List continued on next page.)

*Primary Examiner*—Peter Kratz

*Attorney, Agent, or Firm*—Burns, Doane, Swecker & Mathis

[57] ABSTRACT

The invention relates to a process for the refining of a raw gas produced from a carbonaceous material by means of a gasification process, refining taking place in a secondary stage separated from the gasifier. In order to reduce the gas contents of tar in the form of organic compounds condensible at lower temperatures, such as ambient temperatures, and of ammonia, the refining is carried out in a secondary stage being a fast circulating fluidized bed, the bed material of which at least mainly being an active material in the form of a material that is catalytic for tar and ammonia conversion, whereby a catalytic conversion of tar and ammonia contained in the raw gas is obtained. In order to decrease the content of hydrogen chloride in the gas, an active material that also can absorb chloride is used. Fresh catalytic and absorbing material is supplied in an amount sufficient to have the hydrogen chloride present in the raw gas absorbed on the material, a corresponding amount of the material containing absorbed chloride being discharged from the secondary stage.

30 Claims, 1 Drawing Sheet

OTHER PUBLICATIONS

J. Japan Petrol. Inst., vol. 21, No. 1, pp. 2 to 9 (1978).

"New Possibilities for Gasification of Peat at Low Temperature" by E. Rensfelt et al., pp. 310 to 316.

"Catalytic Conversion of Tars, Carbon Black and Methane from Pyrolysis/Gasification of Biomass", Clas Ekström et al., presented at Fundamentals of Thermochemical Biomass Conversion, Colorado, USA (Oct. 19 to 22, 1982).

"Kinetics of Wood Tar Pyrolysis" by P. Magne et al., Third E.C. Conference, Venice (Mar. 25 to 29, 1985).

"Flash Pyrolysis of Biomass in Sweden", by Clas Ekström et al., Specialists Workshop on Fast Pyrolysis of Biomass Proceedings, pp. 303 to 325, Copper Mountain, Colorado (Oct. 19 to 22, 1980).

"Moving-Bed Air and Oxygen Biomass Gasification", T. B. Reed et al., pp. 295 to 318, 17th Biomass Thermochemical Conversion Contractors Meeting (Oct. 15, 1985).

"Effect of Calcined Dolomite on the Fluidized Bed Pyrolysis of Coal", Yaw D. Yeboah et al., Ind. Eng. Chem. Process Des. Dev., vol. 19, pp. 646 to 653 (1980).

"Thermochemical Gasification of Woody Biomass", H. F. Feldman et al., pp. 352 to 375 (1981) from Biomass as a Nonfossil Fuel Source published by the American Chemical Society.

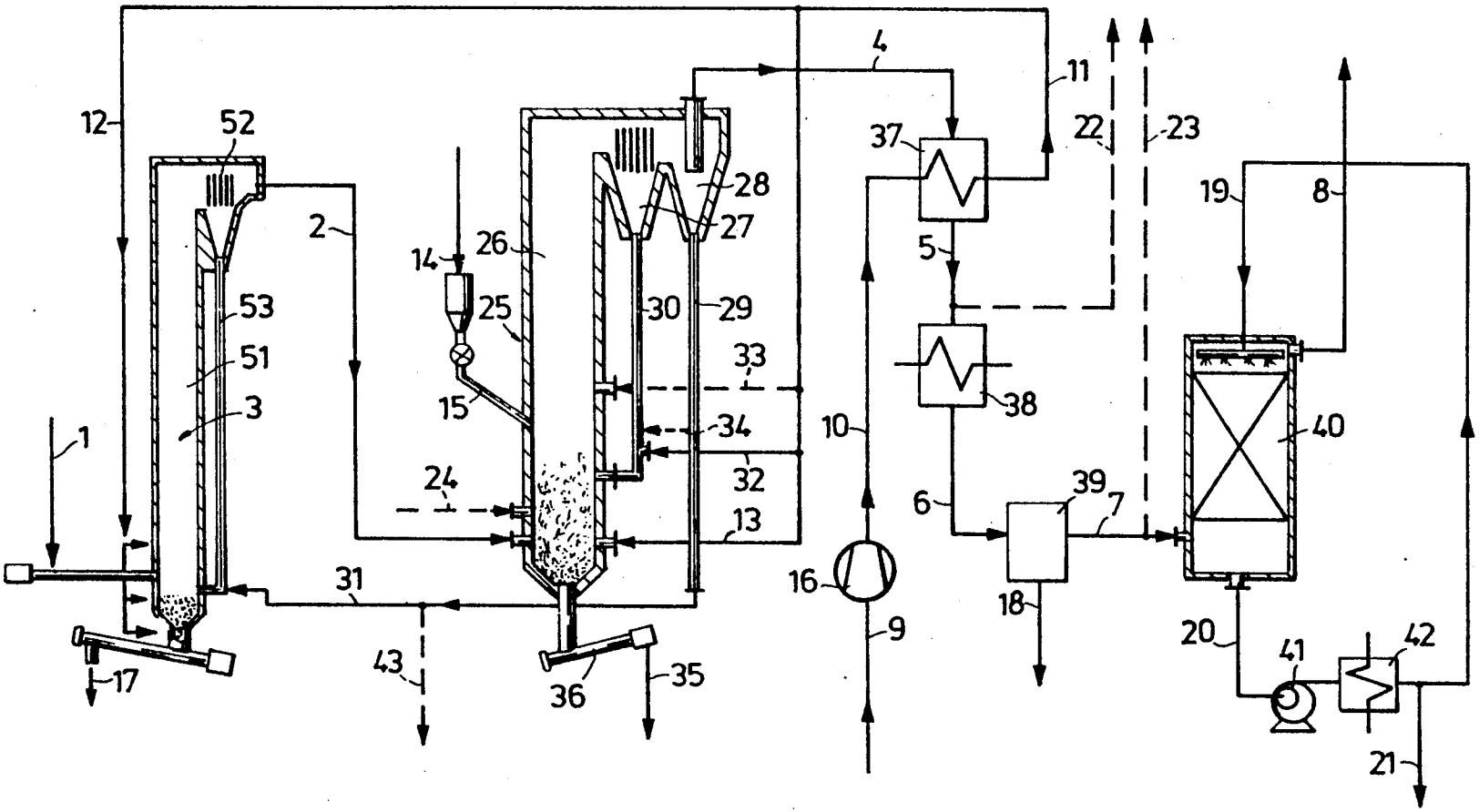
1
2
3
4
5
6
7
8
9
10
11
12
13
14
15
16
17
18
19
20
21
22
23
24
25
26
27
28
29
30
31
32
33
34
35
36
37
38
39
40
41
42
43
51
52
53

REFINING OF RAW GAS

This application is a continuation of application Ser. No. 733,969, filed Jul. 22, 1991, which is a continuation of Ser. No. 469,414, filed Apr. 2, 1990, both now abandoned and is based on International Application PCT/SE88/00502 filed Sep. 28, 1988.

This invention relates to a process for the refining of a raw gas produced from a carbonaceous material by means of a gasification process in which the refining takes place in a secondary stage separated from the gasifier of the gasification process.

A raw gas produced from different kinds of biofuels and used as a fuel gas is a valuable oil substitute for demanding applications in which the process demands make direct solid fuel fireing impossible, e.g. fireing of lime kilns or conversion of existing oil fired boilers.

For other types of applications, e.g. so-called cogeneration (of electrical power and heat) by use of diesel engines, very high demands on the gas purity concerning primarily tars and dust are set. Moreover, environmental aspects often lead to demands on low concentrations of compounds which when combusted form harmful emissions, such as $NO_x$, $SO_x$ and various chlorinated compounds. The last mentioned is valid especially for a gas produced from refuse derived fuel, RDF. These demands on the gas purity can be satisfied by the raw gas being refined by an appropriate method.

Gasification of RDF with subsequent refining of the raw gas means an environmentally favourable method for energy recovery from wastes by utilization of refined gas in existing boilers or for cogeneration in diesel engines and/or boilers.

Besides, utilization of raw gas often is connected with other technical problems.

At temperatures below 1200° C. tar is always present in a raw gas produced by gasification of a carbonaceous material, e.g. coal, peat, bark, wood or RDF, which limits the utilization to combustion of hot gas in direct or close connection to the gasifier. Operational disturbances caused by tarcoating on apparatuses and armatures are a great problem which limits the availability. During combustion of hot gas, nitrogen and in certain cases also sulphur (e.g. from peat) bound in tars, as well as ammonia, $H_2S$ (peat) or HCl (from RDF), furthermore give rise to emissions which are harmful to the environment ($NO_x$, $SO_x$ and HCl, respectively, and chlorinated hydrocarbons, i.a. dioxines).

Despite extensive research concerning tar and ammonia conversion, so far no process which in an industrial scale can achieve sufficiently far-reaching raw gas refining has been developed. The traditional way of reducing tar contents in a raw gas is by means of wet scrubbing, but aerosol formation in the scrubber makes the tar removal inefficient. Furthermore, a process water with high contents of organic compounds and ammonia is obtained. Consequently, this water in its turn must be cleaned before being discharged to a sewerage. When gasifying RDF the process water also contains high concentrations of dissolved hydrochloric acid and/or ammonium chloride. When gasifying more sulphur rich fuels, e.g. peat or coal, the raw gas also has to be purified to remove hydrogen sulphide.

The object of the presented invention is to provide a raw gas refining process, by means of which the above mentioned problems will be solved to a great extent.

This object is achieved by the process according to the invention having the features defined in the enclosed claims.

The invention thus concerns a process for the refining of a tar and ammonia containing raw gas, in special cases also containing considerable quantities of hydrogen chloride, the gas being produced by means of an arbitrary gasification process from a carbonaceous material, e.g. bark, wood, peat or Refuse Derived Fuel, RDF, wherein in a secondary stage conversion takes place in contact with an appropriate active (catalytic and possibly absorbing) material, e.g. dolomite, of the tar and ammonia present in the raw gas, preferably to such a level that the remaining contents are below 500 and 300 mg/$Nm^3$ respectively. In special cases absorption of hydrogen chloride to almost thermodynamic equilibrium simultaneously takes place. The secondary stage consists of a Circulating Fast Fluidized Bed (CFB) with a bed material at least mainly in form of an active material, e.g. dolomite. With this arrangement the secondary stage also could be integrated with an arbitrary CFB-gasifier, only preceded by a primary particle separator, or another type of gasifier.

We have found that sufficient conversion of tars and ammonia and in special cases simultaneous absorption of hydrogen chloride can be achieved, by first separating the tar containing gas from pyrolysing larger fuel particles in the gasifying stage and then in a separate secondary stage in the form of a circulating fast fluidized bed contacting the gas with a suitable active material, such as dolomite, at suitable process parameters.

If the carbonaceous material also contains sulphur in considerable amounts, which e.g. is the case for peat, absorption of hydrogen sulphide on the catalytic and absorbing material will of course also take place.

The amount of active material which is required in relation to the raw gas amount is determined by the required space-velocity for catalytic conversion of tars and ammonia and depends on several parameters such as the temperature, the residence time of the gas, the particle size of the active material, the partial pressure of reactants and the degree of deactivation of the active material. Too low temperature and/or $CO_2$ partial pressure can result in the tar conversion causing carbon deposition on the active surface, which results in deactivation. If this occurs the material can be activated by treatment with an oxidizing gas, e.g. air and/or steam. Absorption of HCl (and/or $H_2S$) takes place so rapidly at the temperatures of interest that these reactions become almost determined by the equilibrium and result in a consumption of active material corresponding to the formed solid chloride (and sulphide resp.).

We have thus found that absorption of chloride (and in certain cases also of hydrogen sulphide) on an active material such as dolomite is a rapid reaction and requires presence of a considerably less amount of active material in relation to the gas flow than catalytic conversion of tars and ammonia.

Utilization of a secondary stage in the form of a fast circulating fluidized bed (CFB) means considerable advantages.

Such a bed is able to handle dust entrained from the gasifier, gives very uniform temperatures in the reaction zone and also gives a homogeneous contact between gas and bed material, that is to say little risk for variations in conversion/absorption degree. Further, the particle size can be varied downwards to a great extent, for those cases in which this is needed to give increased conversion at a given temperature and space-velocity. Considerable erosion of the bed material also results in increased accessible active surface. Also, a secondary stage designed as a CFB with advantage can be integrated with an arbitrary CFB gasifier, which merely has a primary particle separator, or another type of gasifier. One also achieves relatively small diameters when scaling up, since the gas velocities can be kept relatively high, up to about 10 m/s, preferably up to 6 m/s.

In case the gasifier consists of a CFB gasifier, a connection directly after primary dust separation can thus be made. If an active material is used as a bed material in the CFB gasifier, the secondary stage can in an advantageous manner be integrated with the gasifier, e.g. so that dust from a secondary particle separator after the secondary stage is totally or partly recycled to the gasifier. In this way, the total losses of bed material also become lower, and one also obtains the advantage of using only one type of bed material.

The necessary amount of active material in the reactor shaft of the secondary stage for sufficient catalytic conversion of tar and ammonia is controlled by the totally added amount and by controlled recirculation of bed material. Required conversion determines suitable combination of temperature, particle size and amount of active material. Because of abrasion, deactivation and/or absorption of HCl (and possibly $H_2S$) consumed active material is replaced by adding corresponding amounts of fresh active material and/or activated such material. The residence time of the gas can be controlled by the combination diameter/height above the gas inlet.

In those special cases, when HCl is present in the raw gas in considerable amounts, the active material entrained by the outlet gas from the secondary stage means that the HCl absorption is improved, since thermodynamically it becomes more far-reaching at lower temperatures, under the condition that the refined gas is cooled down to an essentially lower temperature before final dust removal.

BRIEF DESCRIPTION OF THE DRAWINGS

In the following the invention will be described by way of a non-limiting embodiment while referring to the enclosed drawing, which schematically shows a gasification and gas refining system which embodies the present invention.

In the system shown in the drawing carbonaceous material 1 is conveyed to a gasifier 3, which consists of a circulating fast fluidized bed (CFB). This comprises a reactor 51, a primary separator 52 and recirculation means 53 for bed material separated in the primary separator. The bed material consists of an active catalytic and absorbing material, preferably in the form of dolomite, mixed with ungasified carbonaceous material, char. The primary separator 52 is a mechanical separator of non-centrifugal type, suitably a U-beam separator, in accordance with what is described in our European Patent EP 0 103 613, relating to a CFB boiler and hereby referred to.

The hot raw gas 2 produced in the gasifier 3 is withdrawn directly from the primary separator 52 and is fed directly to a gas cleaning secondary stage 25 without any additional dust removal. The secondary stage 25 is designed as a circulating fast fluidized bed (CFB) 26 and has the same kind of active bed material as the gasifier 3.

The raw gas 2 is supplied to the secondary stage 25 so that it constitutes a fluidizing gas.

The secondary stage 25 is designed with a long and narrow reactor shaft with arbitrary cross section (e.g. circular or square). Bed material which follows with the gas stream out from the top of the reactor shaft is separated to a major part in a primary particle separator 27, preferably a U-beam separator of the same kind as the U-beam separator of the gasifier, followed by a secondary separator 28, preferably a cyclone. The material 30 separated in the primary particle separator is recycled to the lower part of the circulating bed 26 through a recirculation facility. The material 29 separated in the secondary particle separator 28 is added mainly to the lower part of the gasifier 3, stream 31. When needed, a part of the material stream 29 also can be supplied to the lower part of the circulating bed 26, stream 34, and/or be discharged out of the system, stream 43.

For feeding fresh catalytic and absorbing material 14 to the secondary stage 25 a side feeding device 15 located on a suitable height is used. Consumed and/or deactivated bed material 35 is discharged by means of a discharging device 36 located in connection with the bottom of the secondary stage 25.

The active material used in the secondary stage in this example consists of a calcium-magnesium carbonate containing material, preferably dolomite, with a particle size smaller than 2 mm, preferably smaller than 1 mm, which in combination with the passing gas forms the fast circulating fluidized bed 26.

The gas velocity in the upper section of the reactor shaft, calculated on the free cross section, is adjusted so that it is below 10 m/s, preferably not above 6 m/s.

The fluidizing gas of the fast circulating bed 26 consists of the raw gas 2 and added oxidizing gas 13, e.g. air. When needed additional oxidizing gas 33 can be added to the secondary stage 25 on one or on several other suitable, higher located levels.

Conversion of tar and ammonia contained in the raw gas 2 and absorption of chloride contained in the raw gas take place by means of contact with the catalytic and absorbing material in the circulating bed 26 within a temperature interval of 600°-1000° C., preferably 700°-900° C. or most preferably 850°-950° C. The required temperature level is maintained by burning combustible gas components inside the secondary stage 25, which is controlled by adjustment of the amount of added oxidizing gas, streams 13 and 33.

The average suspension density in the reactor shaft of the secondary stage 25 is maintained within an interval of 20-300 kg/m$^3$, preferably within an interval of 80-250 kg/m$^3$, so that a necessary contact between the passing gas and the active material is obtained. This is achieved by adjusting the total amount of circulating material in combination with controlling the flow rate of recycled material 30 and 34.

The residence time of the gas in the reactor shaft, calculated on an empty reactor shaft, is maintained within an interval of 0.2-20 s, preferably within an interval of 0.5-7 s.

When needed, activation of deactivated catalytic and absorbing material can be performed by adding oxidizing gas 32, e.g. air, to the material which is recycled to the lower part of the circulating bed, streams 30 and 34. The amount of added oxidizing gas 32 is controlled so that the activation takes place within a temperature interval of 600°-1000° C., preferably within an interval of 750°-900° C.

Before starting operation of the process heating of the secondary stage 25 including its bed material takes place by means of combustion of LP gas 24 therein.

The refined gas stream 4 leaving the secondary separator 28 of the secondary stage 25 is relieved from entrained finely divided bed material and steam in the subsequent gas treatment stages.

The gas passes through two heat exchangers. In the first heat exchanger 37 heat exchange takes place with oxidizing gas, stream 10, intended for both the gasifier 3 and the secondary stage 25, so that preheated oxidizing gas 11 at the outlet from the heat exchanger 37 has a suitable temperature, preferably about 400° C. The preheated oxidizing gas 11 is used both in the gasifier 3 (among others as fluidizing gas), stream 12, and in the secondary stage 25, streams 13, 32 and 33.

In the subsequent second heat exchanger 38 the temperature of the gas 5 is lowered to a level which permits the outlet gas 6 to be further cleaned by using e.g. standard textile filters or a cyclone for further dust removal, at 39, i.e. preferably down to 150°-300° C. The removed dust 18 is withdrawn from the dust removal stage 39.

As mentioned before, the gas stream 4 contains entrained finely divided active material which follows with the gas stream out of the secondary separator 28. In special cases, e.g. in connection with gasification of RDF, the raw gas 2 from the gasifier contains considerable amounts of HCl. Since absorption of HCl on calcareous materials, such as dolomite, is favoured by sinking temperature, the gas cooling in the heat exchangers 37 and 38 contributes to increase the degree of absorption of residual HCl on the entrained material.

The almost dust-free gas 7, which leaves the dust removal stage 39, is fed to a scrubber 40, in which it is relieved from moisture and other water soluble components. In the scrubber 40 both moistening of the gas stream 7 and condensation of steam take place. At the current conditions also precipitation of almost all of the residual fines and absorption of water soluble gas components, e.g. $NH_3$, HCl and/or $NH_4Cl$, take place.

The water stream 20 leaving the scrubber 40 is recirculated by a pump 41, whereby it is cooled in a heat exchanger 42, so that the temperature of the water 19 recycled to the scrubber 40 is kept within the interval 15°-20° C. Excess water 21 is drained from the water circuit.

The gas 8 leaving the scrubber can for industrial applications be regarded as pure, i.e. it is almost free from tars, ammonia, dust, HCl and $H_2S$. However, at the present outlet temperatures (about 30° C.) it is saturated with steam. Depending on the application, in order to decrease the relative humidity, the gas stream 8 can be preheated or passed through an additional drying stage in order to reduce its moisture content. The pure gas satisfies the requirements for engines, and can be burned without any subsequent exhaust gas cleaning.

For more simple applications, e.g. heat generation in boilers, the scrubber 40 can be omitted, so that the refined gas can be utilized either directly after the heat exchanger 37, stream 22, or after the dust separator 39, stream 23.

In the described example the secondary stage 25 has been integrated with a gasifier 3 based on CFB technology. The gasifier 3 can produce the raw gas 2 from several different kinds of fuels, e.g. coarse bark, peat or refuse derived fuels RDF. As bed material in the circulating bed of the gasifier 3 it is, as mentioned, convenient to use a catalytic and absorbing material of the same type as in the secondary stage 25.

The total pressure drop of the oxidizing gas supplied, e.g. air, at the passage through the production loop, is slightly above 1 bar. This sets requirements on using a compressor 16, which increases the oxidizing gas pressure in stream 9 to the pressure level in stream 10 necessary in view of the purpose involved.

We claim:

1. In a process for the refining of a raw gas produced from a carbonaceous material by means of gasification, the raw gas containing tar and ammonia as impurities, the improvement comprising:

(a) contacting the raw gas in a secondary stage separate from the gasification, the secondary stage comprising a fast circulating fluidized bed containing active material which acts as a catalyst for conversion of tar and ammonia in said raw gas;

(b) maintaining the average suspension density of the catalytic material in said fluidized bed at a level between about 80 and about 250 $kg/m^3$;

(c) converting said tar and ammonia in said raw gas by catalytic reaction in said fluidized bed to thereby result in a refined gas having a tar concentration of less than about 500 $mg/Nm^3$ and an ammonia concentration of less than about 300 $mg/Nm^3$, said tar being converted by catalytic cracking, wherein the catalytic material is selected from the group consisting of magnesium-calcium carbonate, calcined magnesium-calcium carbonate, and mixtures thereof; and the operating temperature of the secondary stage is maintained at between about 600° C. and about 1000° C.; and (d) separating the refined gas from the active material by means of particle separation.

2. A process according to claim 1, including the step of monitoring and adjusting reaction parameters to maintain the concentrations of tar and ammonia in said refined gas at the levels recited in step (c), said reaction parameters including the particle size and quantity of active material in said fluidized bed, the operating temperature and the residence time of the raw gas in the fluidized bed.

3. A process according to claim 1, wherein said raw gas includes hydrogen chloride as an impurity and said active material is a chloride absorbing material, and wherein said process includes the steps of absorbing chloride on said absorbing material and discharging the active material containing said absorbed chloride from the secondary stage.

4. A process according to claim 1, wherein the operating temperature of the secondary stage is maintained at between about 850° C. and about 950° C.

5. A process according to claim 1, including the step of controlling the operating temperature of the secondary stage by addition of oxygen containing gas to the fluidized bed.

6. A process according to claim 1, wherein said magnesium-calcium carbonate comprises dolomite.

7. A process according to claim 1, wherein said active material becomes deactivated during said refining, and wherein said process includes the step of discharging deactivated active material from said secondary stage and replacing the discharged deactivated material with an equivalent amount of active material selected from one or both fresh and activated catalytic material.

8. A process according to claim 7, wherein the deactivated material discharged from the secondary stage is activated by treatment with an oxidizing gas in a separate oxidizing stage and said activated material is recycled to the secondary stage.

9. A process according to claim 8, wherein the oxidizing gas is selected from the group consisting of an oxygen containing gas, steam and mixtures thereof.

10. A process according to claim 1, wherein said active material becomes deactivated during said refining and wherein said process includes the steps of discharging the deactivated material from the fluidized bed, activating it by treatment with an oxidizing gas, and recycling the activated material via a recirculation system.

11. A process according to claim 8, wherein the activation takes place at an operating temperature of from about 600° C. to about 1000° C.

12. A process according to claim 8, wherein the activation takes place at an operating temperature of from about 750° C. to about 900° C.

13. A process according to claim 8, wherein the operating temperature of the activation is controlled by addition of a gas-containing oxygen.

14. A process according to claim 3, wherein a portion of the active material remains with the refined gas after the particle separation step (d), the hydrogen chloride content of the refined gas being lowered further by means of absorption on the remaining active material, and wherein the process includes the steps of lowering the temperature of the refined gas and subjecting the refined gas to additional particle separation for removal of the remaining active material.

15. A process according to claim 1, wherein the gasification comprises a fast circulating fluidized bed including a particle separator and utilizes active material of a type similar to that of the secondary stage, wherein the raw gas feed to the secondary stage comprises the output from the particle separator of the gasification, and wherein said process includes the step of recycling at least part of the active material separated in the particle separation of the secondary stage to the lower part of the fluidized bed of the gasification, thereby at least partly replacing active material lost through entrainment with the raw gas, through discharge from the bottom of the gasification fluidized bed, or both.

16. A process according to claim 1, characterized in that the raw gas is supplied to the secondary stage directly from the gasifier without any intermediate dust removal.

17. A process according to claim 16, wherein the gasifier comprises a fast circulating fluidized bed, characterized in that the raw gas is supplied to the secondary stage directly from the primary separator of the gasifier without any additional dust separation.

18. A process according to claim 1, characterized in that the fluidizing gas of the secondary stage comprises the raw gas and an oxidizing gas.

19. A process according to claim 18, characterized in that oxidizing gas which does not constitute a fluidizing gas, is added to the reactor of the secondary stage at one or several levels above the fluidizing gas supply.

20. A process according to claim 1, characterized by chosing the total amount of active material present in the secondary stage and controlling the recirculation flow of bed material for providing a suspension density of the circulating fast fluidized bed such that the desirable contact between the passing gas and the active material, for the catalytic conversion, is accomplished.

21. A process according to claim 1, characterized in that the gas velocity in the secondary stage calculated on an empty reactor shaft, is maintained below 10 m/s.

22. A process according to claim 1, characterized in that the particle size of the catalytic and absorbing material is smaller than 2 mm.

23. A process according to claim 1, characterized in that the residence time of the gas calculated on an empty reactor shaft, is kept within the interval of 0.2–20 s.

24. A process according to claim 3, characterized in that the operating temperature of the secondary stage is controlled by added amounts of oxygen containing gas.

25. A process according to claim 1, characterized in that the operating temperature of the secondary stage is controlled by added amounts of oxygen containing gas.

26. A process according to claim 3, characterized in that the operating temperature of the secondary stage is controlled by added amounts of oxygen containing gas.

27. A process according to claim 10, characterized in that the activation takes place at an operating temperature within the interval of 600°–1000° C.

28. A process according to claim 10, characterized in that the operating temperature of the activation is controlled by means of added amounts of gas containing oxygen.

29. A process according to claim 11, characterized in that the operating temperature of the activation is controlled by means of added amounts of gas containing oxygen.

30. A process according to claim 27, characterized in that the operating temperature of the activation is controlled by means of added amounts of gas containing oxygen.

* * * * *